US006907192B2

(12) United States Patent
Ito et al.

(10) Patent No.: US 6,907,192 B2
(45) Date of Patent: Jun. 14, 2005

(54) HYBRID HOTAIR HEATER

(75) Inventors: Keiichi Ito, Aichi-ken (JP); Toshiyuki Nomura, Aichi-ken (JP); Yoshinori Fujisawa, Aichi-ken (JP); Yukihiko Shimonoma, Aichi-ken (JP); Yoshimune Yamada, Aichi-ken (JP)

(73) Assignee: Rinnai Corporation, Aichi-ken (JP)

( * ) Notice: Subject to any disclaimer, the term of this patent is extended or adjusted under 35 U.S.C. 154(b) by 4 days.

(21) Appl. No.: 10/726,683

(22) Filed: Dec. 4, 2003

(65) Prior Publication Data

US 2004/0151480 A1 Aug. 5, 2004

(30) Foreign Application Priority Data

Dec. 24, 2002 (JP) ..... 2002-371397

(51) Int. Cl.[7] ..... F24D 13/00
(52) U.S. Cl. ..... 392/307; 392/365
(58) Field of Search ..... 392/307, 360–369, 392/347; 219/476, 486

(56) References Cited

U.S. PATENT DOCUMENTS 1,429,130 A * 9/1922 Dutton ..... 392/369
2,060,079 A * 11/1936 Hood ..... 126/92 AC
5,937,139 A * 8/1999 Peterson ..... 392/307
6,795,643 B2 * 9/2004 Ito et al. ..... 392/307

FOREIGN PATENT DOCUMENTS

| | | |
|---|---|---|
| AT | 272471 | * 7/1969 |
| JP | 55-63348 | * 5/1980 |
| JP | 58-184431 | * 10/1983 |
| JP | 1-314505 | * 12/1989 |

* cited by examiner

*Primary Examiner*—John A. Jeffery
(74) *Attorney, Agent, or Firm*—Arent Fox

(57) ABSTRACT

If both the electric heaters and combustion heaters constitute a hybrid type hot-air heater wherein both heaters are equipped with inlets adjacent to each other and are also housed within a frame and separated such that the air blowing systems of each heater are independent of each other, air leakage will occur in only the combustion heater during the heating operation in a direction opposite to the air blowing passage of the electric heater thereby resulting in dust adhering to the electric heater. If the electric heater is operated in this state, the dust will be heated and then burn causing a foul odor to occur when the heating operation first starts. Therefore, the air blowing fan 43 runs to remove any dust that entered into the air blowing passage before the electric heater 4 runs when the electric heater unit 4, equipped with an electric heater 44, is performing a heating operation.

4 Claims, 5 Drawing Sheets

HYBRID HOTAIR HEATER

BACKGROUND OF THE INVENTION

1. Field of the Invention

The present invention relates to a hybrid hotair heater in which a plurality of heating means are incorporated in one frame.

2. Description of the Related Art

Jpn. Pat. Appln. KOKAI Publication No. 2000-9347, for example, describes a hybrid hotair heater in which a combustion heater portion and an electric heater portion are incorporated in a frame and one air blowing fan constitutes an air blowing system. In this case, if the air blowing system is controlled by the one air blowing fan, a quantity of generated heat is different between a case where the electric heater portion is used for heating in addition to the combustion heater portion and a case where only the combustion heater portion is used for heating while the electric heater portion is at rest, so that to prevent overheating it is necessary to make different a quantity of air to be sucked in the frame between these two cases, thus making it difficult to operate the combustion heater stably because of a difference in quantity of combustion air.

Therefore, is may be considered to arrange the combustion heater and the electric heater one above the other in such a configuration that the air blowing fan as well as an inlet and an outlet may be provided for each of them to thereby make the respective air blowing systems independent of each other. In this case, the outlets and the inlets are provided adjacent to each other in, for example, a front face and a rear face of an appliance respectively.

It is to be noted that in a case where a hybrid hotair heater is arranged as described above to provide an inlet in a combustion heater portion and that in an electric heater portion adjacent to each other, if only a combustion heater portion is operated for heating, as air around the inlet in this combustion heater is sucked in a frame, the air may in some cases flow back from an outlet in the electric heater portion to the inlet through an air blowing passage.

In such a case, dust around the outlet is sucked in the air blowing passage of the electric heater portion and sticks to the electric heater provided in this air blowing passage. If the electric heater is operated in this condition, the dust is heated to burn, so that nasty smell occurs when heating starts, which is a problem. In this case, a filter is mounted over the inlet, but it is not desirable to mount a filter over the outlet of which hotair is blasted out, because the filter provides resistance against the hotair.

In view of the above, it is an object of the present invention to provide a hybrid hotair heater that can prevent offensive smell from occurring when heating starts by use of an electric heater.

SUMMARY OF THE INVENTION

To solve the above problem, a hybrid hotair heater according to the present invention incorporates in a frame at least two heater portions each of which has an air blowing passage leading from an inlet to an outlet which air blowing passage is provided with an air blowing fan and heating means, in such a configuration that the inlets in these heater portions may be formed adjacent to each other and that air blowing systems of the heaters may be independent of each other in partitioning, in which one of the heating means is used as an electric heater and the other is used as a combustion heater so that when an electric heater portion comprising this electric heater is operated for heating, the blowing fan may be operated prior to operation of the electric heater to thereby remove dust which has entered in the air blowing passage.

According to the present invention, only the combustion heater portion is operated, so that if dust present around the outlet is sucked in the air blowing passage of the electric heater portion and sticks to the electric heater when air flows back from the outlet through the air blowing passage to the inlet in the electric heater portion, the dust which has entered into the air blowing passage is removed by operating the air blowing fan prior to operation of the electric heater, thereby preventing offensive smell from occurring when heating starts by use of the electric heater portion.

In this case, since hotair is blasted out from the beginning of heating, it is preferable to once stop operation of the air blowing fan of the electric heater portion when a predetermined lapse of time has elapsed from a point in time of its start in operation and then operate the electric heater, thus restarting operation of the air blowing fan after elapsing of a predetermined lapse of time.

Further, when only the combustion heater portion comprising the combustion heater is used for heating, each time a predetermined lapse of time elapses from starting of the heating, the air blowing fan of the electric heater portion can be operated for a constant lapse of time, to periodically remove dust stuck to the electric heater, thus quickly operating the electric heater portion when the electric heater portion is used in addition to the combustion heater portion. It is to be noted that the combustion heater may be a gas burner.

As described above, a hybrid hotair heater according to the present invention has an effect that offensive smell can be prevented from occurring when heating starts by use of an electric heater.

DESCRIPTION OF THE PREFERRED EMBODIMENTS

Figure 1:
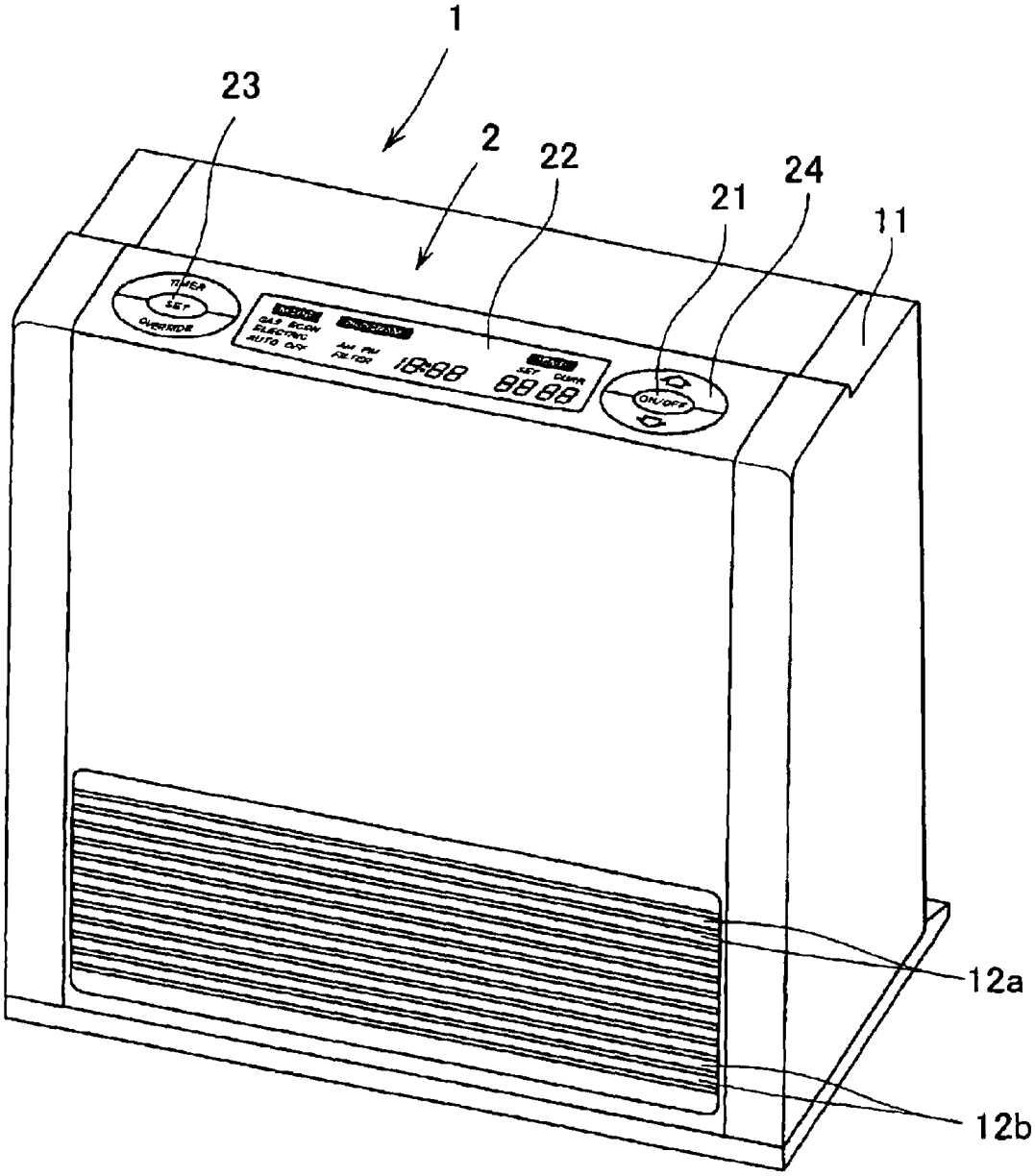
FIG. 1 is a perspective view of a hybrid hotair heater according to the present invention.
Figure 2:
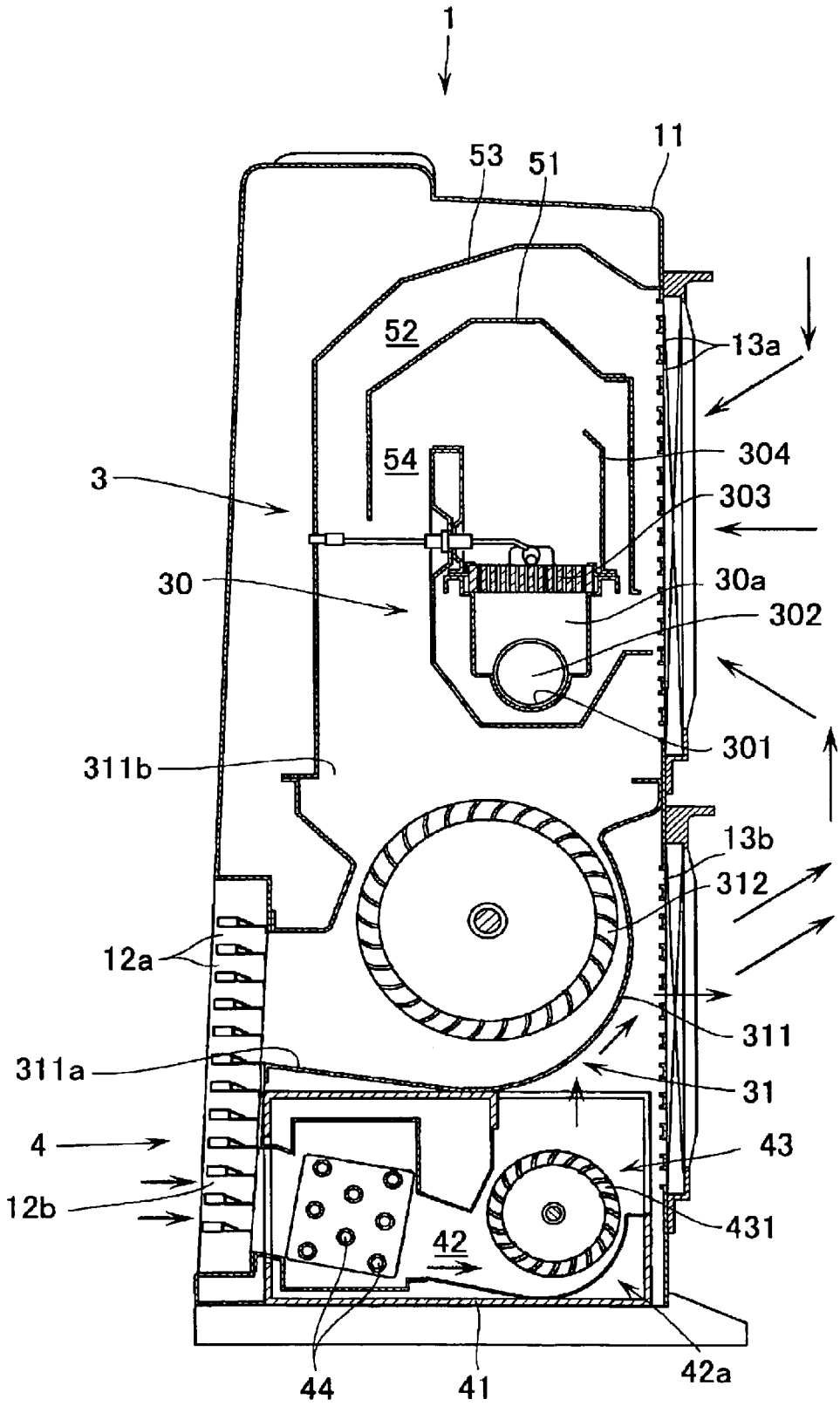
FIG. 2 is an explanatory vertical cross-sectional view of a configuration of the hybrid hotair heater according to the present invention.

In FIGS. 1 and 2, a reference numeral 1 indicates a hybrid hotair heater according to the present invention. This hotair heater (hereinafter referred to as "appliance") 1 has a box-shaped frame 11. The frame 11 is provided on its upper face with an operation portion 2 for controlling heating of the appliance 1. This operation portion 2 comprises a driving switch 21, a display 22 for displaying set temperature and time, a driving mode setting switch 23 for instructing a microcomputer (not shown) provided in the appliance to make predetermined setting, and setting changing switches 24 disposed above and below the driving switch 21 respectively. In the frame 11, there are incorporated a gas heater portion 3 on an upper side and an electric heater portion 4 on a lower side. A first outlet 12*a* and a second outlet 12*b* are formed in a front face of the frame 11 and a first inlet 13*a* and a second inlet 13*b* are formed in a rear face of the frame 11 to face the gas heater portion 2 and the electric heater portion 3 respectively so that, as described later, two air blowing fans may be used to make an air blowing system of the gas heater portion 3 and that of the electric heater portion 4 independent of each other.

The gas heater portion 3 comprises a gas burner 30 serving as a combustion heater and a first air blowing fan 31 which is arranged below the gas burner 30 and which supplies the gas burner 30 with combustion air and mixes combustion gas from this gas burner 30 with air sucked through the first inlet 13*a* in the frame 11 to blast them out to a room. The gas burner 30 is an all primary air burner and has a burner body 30*a* in which there are formed a fuel/air inlet 301 faced by a gas nozzle (not shown) mounted to a tip of a gas tube connected with an electromagnetic safety valve and a proportional control valve (not shown) which are arranged in the frame 11 and a mixer tube portion 302 communicating with this inlet 301. On an open upper face of the burner body 30*a*, a ceramic combustion plate 303 having a plurality of flame ports provided therein in a row is mounted via a distribution plate (not shown). This gas burner 30 is contained in a combustion frame 304.

In the frame 11, there is also provided a diversion plate 51 in such a manner as to surround an upper side of the combustion chamber 304 and so that when 1 first air blowing fan 31 described later is operated, air sucked through the first inlet 13*a* in the frame 11 and combustion gas from the combustion chamber 304 may be partitioned from each other until they flow by a predetermined distance. In the frame 11, there is provided a partition 53 in such a manner as to cover this diversion plate 51 and so that an air passage 52 may be formed to lead to the first air blowing fan 31 between itself and the diversion plate 51.

The air blowing fan 31 arranged below the burner body 30*a* has a housing 311 in which a air blowing duct 311*a* leading to the first outlet 12*a* is formed. In the housing 311, there is arranged a cross-flow type first moving vane 312 connected to a first motor (not shown) whose rotation speed can be controlled. In this case, the air passage 52 and an internal space of the housing 311 communicate with each other through an upper-face opening 311*b* in the housing 311.

In such a manner, an air blowing system of the gas heater portion 3 leading from the first inlet 13*a* to the first outlet 12*a* is formed. In this configuration, when the first motor is driven to rotate the first moving vane 312, air in the room is sucked through the inlet 13*a* in the frame 11, so that the air is supplied to the inlet 301 in the burner body 30*a* and flows through the air passage 52. In this case, if fuel gas is sprayed through a gas nozzle to the inlet 301, an air-fuel mixture is supplied to the flame port plate 303. It is to be noted that an air/fuel ratio is adjusted by controlling the first motor to control a rotation speed of the first moving vane 312.

Combustion gas from the combustion chamber 304 passes through a combustion gas passage 54 on an inner side of the diversion plate 51 and is sucked toward the first air blowing fan 31. air sucked through the first inlet 13*a* passes through the air passage 52 and undergoes heat exchange through the diversion plate 51 and then is mixed with the combustion gas to be cooled and flow through the opening 311*b* into the housing 311. Then, hotair released through the outlet 12*a* to the room.

On the other hand, the electric heater portion 4 is contained in a case 41 made of resin and has an air blowing passage 42 leading from the second inlet 13*b* to the second outlet 12*b*. In this case, to miniaturize the electric heater portion 4, the air blowing passage 42 is formed as bent in a direction from an upper side of the appliance 1 to a horizontal side. A bent portion 42*a* obtained by thus bending this air blowing passage 42 is provided with a second air blowing fan 43. The second air blowing fan 43 comprises a second motor (not shown) whose rotation speed can be controlled and a cross-flow type second moving vane 431 connected to this second motor and arranged on the bent portion 42*a*. On a downstream side of this bent portion 42*a*, there are provided eight sheathed heaters 44 in such a manner as to intersect with air flowing through the air blowing passage 42.

In such a manner, an air blowing system of the electric heater portion 4 leading from the second inlet 13*b* to the second outlet 12*b* is formed. If, in this configuration, the second motor is driven to rotate the second moving vane 431, air in the room is sucked through the second inlet 13*b* in the air blowing passage 42 and heated while it passes around the sheathed heaters 44 and then is released through the second outlet 12*b* to the room as hotair. It is to be noted that the first and second outlets 12*a* and 12*b* are formed adjacent to each other in such a manner that hotair blasted out of the first air blowing fan 31 and hotair blasted out of the second air blowing fan 43 may flow into each other.

If the first inlet 13*a* and the second inlet 13*b* are adjacent to each other in a case where the appliance 1 is configured as described above, when the first air blowing fan 31 is operated to operate only the gas heater portion 3 for heating and suck air around this first inlet 13*a* in the frame 11, correspondingly, the air may in some cases flow back from the second outlet 12*b* through the air blowing passage 42 to the second inlet 13*b* as indicated by an arrow in FIG. 2.

In this case, dust around the second outlet 12*b* is sucked in the air blowing passage 42 and sticks to the sheathed heaters 44 in this air blowing passage 42. If the sheathed heaters 44 are operated in this condition, the dust is heated to burn, thereby generating nasty smell at the beginning of driving. According to the present embodiment, before the electric heater portion 4 is operated for heating, the second air blowing fan 43 is operated for a constant lapse of time to perform so-called pre-purge, thereby removing dust which has entered into the air blowing passage 42.

Figure 3:
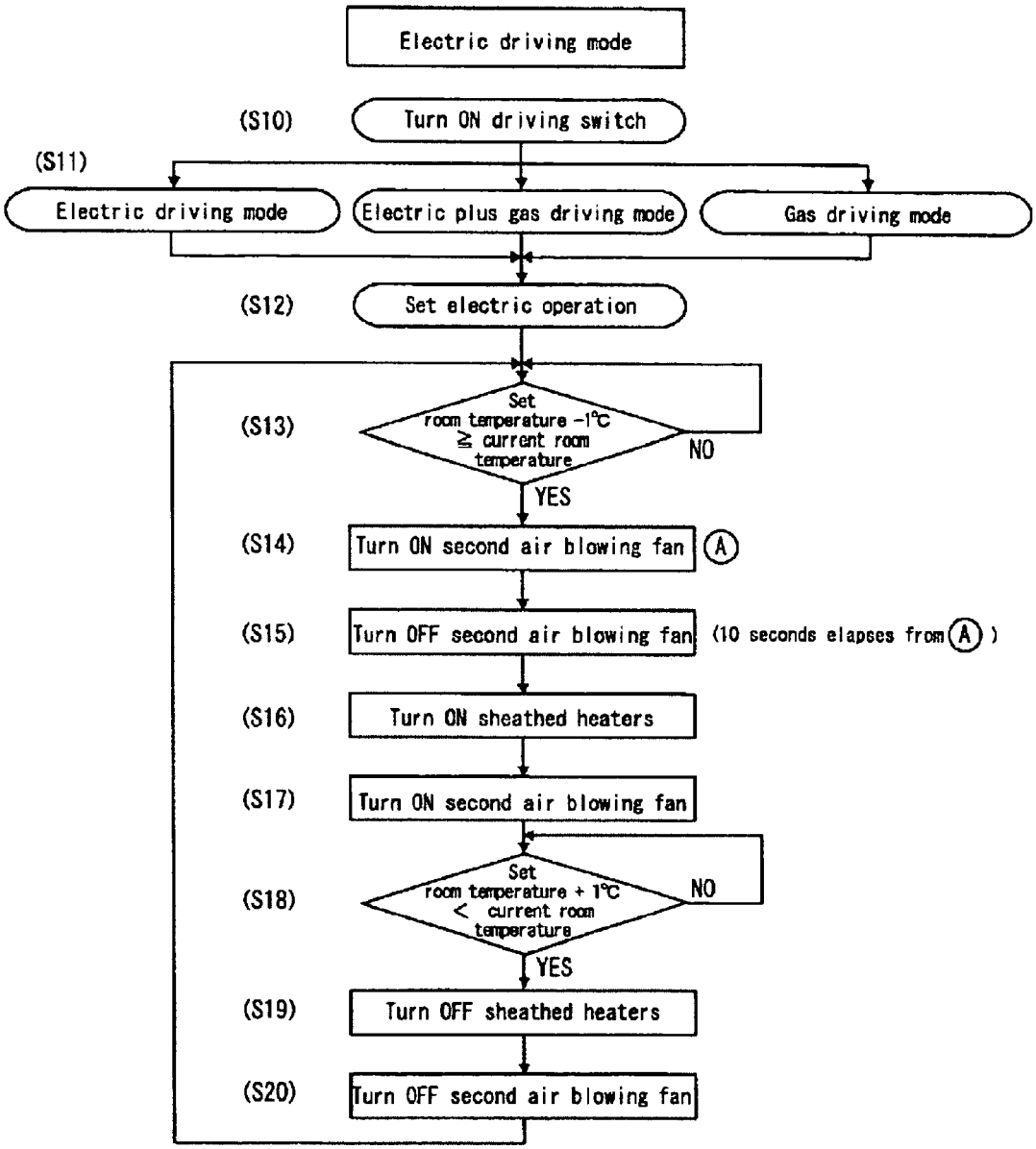
FIG. 3 is an explanatory flowchart of operations of the hybrid hotair heater according to the present invention.

Next, how to heat the appliance 1 according to the present invention is described with reference to FIG. 3. When the driving switch 21 is turned ON in a condition where the appliance 1 is at rest (S10), settings stored in a control unit when this appliance 1 is stopped in heating last time are displayed on the display 22, whereupon heating starts under the settings. In this case, the driving mode setting switch 23 may be pressed to change a heating mode (S11) or the setting changing switch 24 may be pressed to change a set temperature. In the present embodiment, the heating mode can be selected from three modes where only the gas heater portion 3 is operated, where only the electric heater portion 4 is operated, and where the gas heater portion 3 and the electric heater portion 4 are operated simultaneously.

If the electric driving mode is set (S12), the electric heater portion 4 is used for heating. In this case, the process decides whether a current room temperature detected by a room temperature detection sensor (not shown) provided in the frame 11 is lower than a set room temperature by a predetermined temperature (1° C.) or more (S13) and, if such is the case, operates the second air blowing fan 43 (S14) to perform pre-purge, thereby removing dust stuck to the sheathed heaters 44. Then, when a predetermined lapse of time (e.g., 10 seconds) has elapsed from a point in time of start of operation of the second air blowing fan 43, the process once stops this air blowing fan 43 in operation (S15). Next, the process operates the sheathed heaters 44 to perform pre-heating (S16) and restarts operation of the second air blowing fan 43 (S17) to blast hotair out of the second outlet 12*b*. It is thus possible to prevent offensive nasty smell from occurring at the beginning of heating by use of the electric heater portion 4 and also to blast hotair out from the beginning. It is to be noted that the sheathed heaters 44 may be operated after the predetermined lapse of time (10 seconds) has elapsed from a point in time of start of operation of the air blowing fan 43.

When the electric heater portion 4 is being operated for heating, the process decides whether a current room temperature detected by the room temperature detection sensor is higher than a set room temperature by a predetermined temperature (1° C.) (S18) and, if such is the case, stops the sheathed heaters 44 in operation (S19). In this case, to perform so-called post-purge for releasing residual heat out of the air blowing passage 42, the process operates the second air blowing fan 43 for a predetermined lapse of time (90 seconds) from a point in time of stopping of operation of the sheathed heaters 44 and stops it (S20). It is to be noted that also if the driving switch 21 is turned OFF when the electric heater portion 4 is being operated for heating, post-purge is performed to release the residual heat out of the air blowing passage fan 42.

Figure 4:
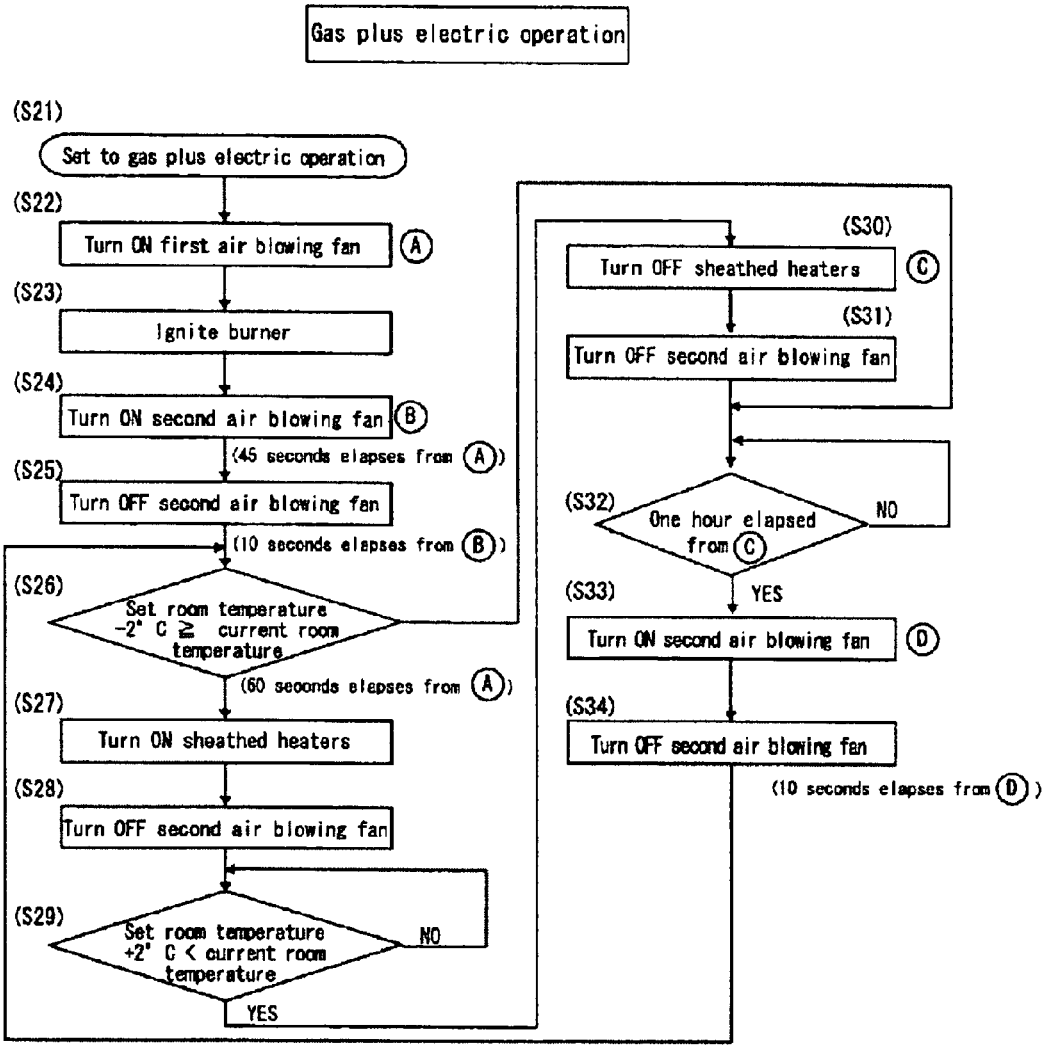
FIG. 4 is another explanatory flowchart of the operations of the hybrid hotair heater according to the present invention.

Next, as shown in FIG. 4, when the mode where the electric and gas heaters are operated is set (S21), the process operates the first blowing fan 31 (S22) and ignites the gas burner 30 (S23). Next, when a predetermined lapse of time (45 seconds) elapses from a point in time of start of operation of the air blowing fan 31, the second air blowing fan 43 is operated (S24) to perform pre-purge. Then, when a predetermined lapse of time (10 seconds) elapses from a point in time of start of operation of the second air blowing fan 43, the process once stops the second air blowing fan 43 in operation (S25). Next, the process decides whether a current room temperature detected by the room temperature detection sensor is lower than a set room temperature by a predetermined temperature (2° C.) or more (S26) and, if such is the case, operates the sheathed heaters 44 (S27) to perform pre-heating and then operates the second air blowing fan 43 (S28) to operate the electric and gas heater portions 3 and 4 for heating.

When the gas and electric heater portions 3 and 4 are being operated for heating, the process decides whether a current room temperature detected by the room temperature detection sensor is higher than a set room temperature by a predetermined temperature (2° C.) (S29) and, if such is the case, stops the sheathed heaters 44 in operation (S30), to automatically switch to heating by use of only the gas heater portion 3. In this case, the process stops the second air blowing fan 43 after performing post-purge by operating the it for a predetermined lapse of time (90 seconds) from a point in time of stopping of operation of the sheathed heaters 44 (S31). Next, the process decides whether a predetermined lapse of time (one hour) has elapsed from a point in time of stopping of operation of the sheathed heaters 44 (S32) and, if. such is the case, operates the second air blowing fan 43 (S33) and, in 10 seconds, stops the second air blowing fan 43 in operation (S34). It is thus possible to periodically remove dust stuck to the sheathed heaters 44 and quickly operate the electric heater portion 4 when it is to be operated in addition to the gas heater portion 3.

Figure 5:
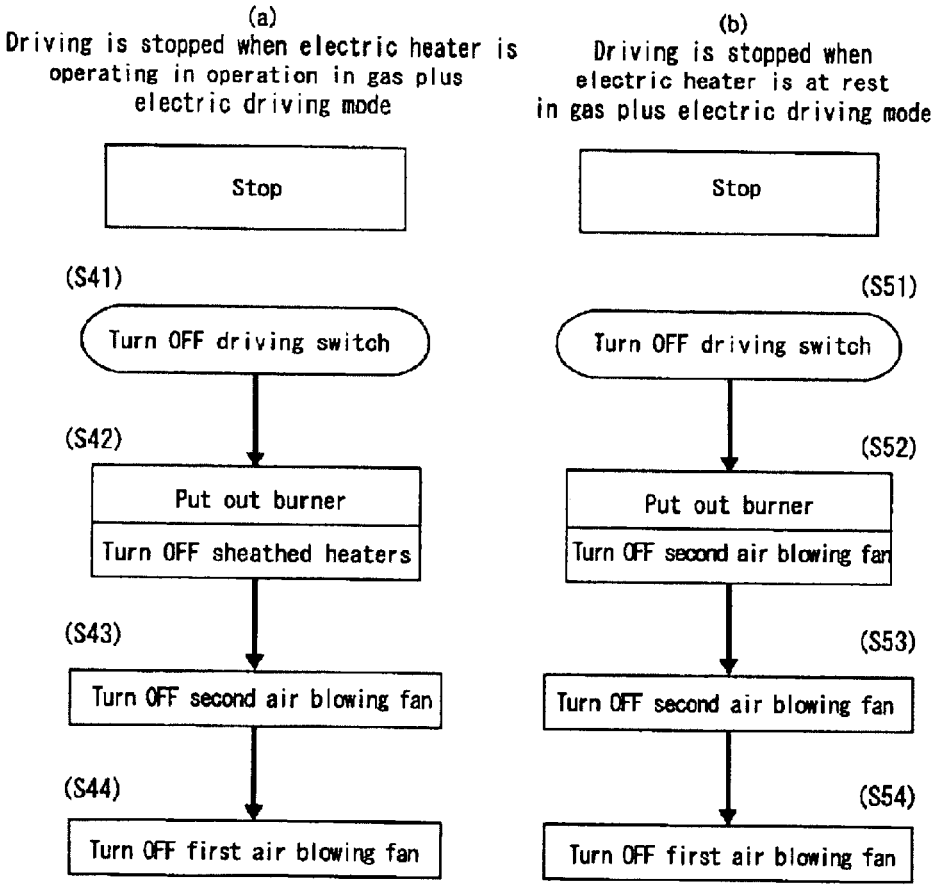
FIGS. 5(*a*) and (*b*) are explanatory flowcharts of operations for stopping the hybrid hotair heater according to the present invention in operation.

Next, as shown in FIG. 5A, if the power switch 21 is turned OFF when the gas and electric heater portions 3 and 4 are being operated for heating in the mode where both of them are used (S41), the process puts out the gas burner 30 and stops the sheathed heaters 44 in operation (S42). Next, the process operates the first and second air blowing fans 31 and 43 for a predetermined lapse of time (90 seconds) from a point in time of stopping of operation of the gas burner 30 and the sheathed heaters 44 to perform post-purge and then stops them (S43, S44). If, on the other hand, the power switch 21 is switched OFF when the electric heater portion 4 is stopped in operation in the mode where both of them are used (S51), the process puts out the gas burner 30 and operates the second air blowing fan 43 (S52). The, when a predetermined lapse of time (10 seconds) has elapsed from a point in time of start of operation of the second air blowing fan 43, the process stops this second air blowing fan 43 in operation (S53) and, in 90 seconds after extinguishing of the gas burner 30, stops the first air blowing fan 31 engaged in post-purge (S54). It is to be noted that if the power switch 21 is turned OFF when the gas heater portion 3 is being operated for heating, the fan is stopped along the same procedure as that of FIG. 5B.

Although the above embodiment has been described with reference to an example where the gas burner is used as a combustion heater, the present invention is not limited to use of the gas burner; for example, any burner such as an oil burner may be used as far as it generates heat by combustion.

What is claimed is:

1. A hybrid hotair heater incorporating in a frame at least two heater portions each of which has an air blowing passage leading from an inlet to an outlet which air blowing passage is provided with an air blowing fan and heating means, in such a configuration that said inlets in these heater portions may be formed adjacent to each other and that air blowing systems of said heaters may be independent of each other in partitioning, in which:

one of said heating means is used as an electric heater and the other is used as a combustion heater so that when an electric heater portion comprising said electric heater is operated for heating, said blowing fan may be operated prior to operation of said electric heater to thereby remove dust which has entered in said air blowing passage.

2. The hybrid hotair heater according to claim 1, in which after a predetermined lapse of time has elapsed from a point in time of start of operation of said electric heater portion, said air blowing fan is stopped once in operation to operate said electric heater, thereby restarting operation of said air blowing fan after elapsing of a predetermined lapse of time.

3. The hybrid hotair heater according to claim 1, in which when only a combustion heater portion comprising said combustion heater is being operated for heating, each time a predetermined lapse of time elapses from a point in time of start of said heating, said air blowing fan of said electric heater portion is operated for a constant lapse of time.

4. The hybrid hotair heater according to claim 1, in which said combustion heater is a gas burner.

* * * * *